US009347225B2

(12) United States Patent
Glancy et al.

(10) Patent No.: US 9,347,225 B2
(45) Date of Patent: May 24, 2016

(54) BUILDING PANEL CONNECTOR

(71) Applicant: Kingspan Insulated Panels, Inc., Deland, FL (US)

(72) Inventors: Brian Glancy, Toronto (CA); Taylor Vail, St. Augustine, FL (US)

(73) Assignee: Kingspan Insulated Panels, Inc., Deland, FL (US)

( * ) Notice: Subject to any disclaimer, the term of this patent is extended or adjusted under 35 U.S.C. 154(b) by 0 days.

(21) Appl. No.: 14/318,617

(22) Filed: Jun. 28, 2014

(65) Prior Publication Data

US 2015/0376903 A1 Dec. 31, 2015

(51) Int. Cl.

| | |
|---|---|
| ***E04F 13/08*** | (2006.01) |
| ***E04B 2/72*** | (2006.01) |
| ***E04F 13/24*** | (2006.01) |

(52) U.S. Cl.

CPC ..... *E04F 13/0805* (2013.01); *E04B 2/721* (2013.01); *E04F 13/24* (2013.01)

(58) Field of Classification Search

CPC ..... E04F 13/0805; E04F 13/24; E04B 2/721
USPC ..... 52/489.1, 489.2, 512, 584.1, 385, 386, 52/387

See application file for complete search history.

(56) References Cited

U.S. PATENT DOCUMENTS

| | | | | |
|---|---|---|---|---|
| 2,818,948 | A | 1/1958 | Jones | |
| 3,080,021 | A * | 3/1963 | Muir | 52/460 |
| 3,417,531 | A | 12/1968 | Jones | |
| 3,554,142 | A * | 1/1971 | Sorenson | E04H 3/12 108/157.13 |
| 3,621,635 | A | 11/1971 | Lange | |
| 4,126,354 | A * | 11/1978 | DeLong | A47C 1/12 108/64 |
| 4,928,467 | A | 5/1990 | Hintsa | |
| 4,961,295 | A | 10/1990 | Kosch, Sr. et al. | |
| 5,544,461 | A | 8/1996 | Sommerstein | |
| 5,809,729 | A | 9/1998 | Mitchell | |
| 6,035,598 | A | 3/2000 | Sukolics et al. | |
| 6,082,810 | A * | 7/2000 | Bennett | 296/184.1 |
| 6,460,311 | B1 * | 10/2002 | Ito | 52/489.1 |
| 6,484,465 | B2 | 11/2002 | Higgins | |
| 6,805,185 | B2 * | 10/2004 | Gravel | E04B 2/7422 160/135 |
| D531,012 | S | 10/2006 | Shih | |
| D608,181 | S | 1/2010 | Koizumi | |
| 7,716,891 | B2 | 5/2010 | Radford | |
| 7,805,899 | B2 | 10/2010 | Montgomery | |
| 7,810,289 | B2 | 10/2010 | Montgomery | |

(Continued)

FOREIGN PATENT DOCUMENTS

| | | |
|---|---|---|
| CN | 201254808 | 6/2009 |
| CN | 202787849 | 3/2013 |

(Continued)

*Primary Examiner* — Charles A Fox
*Assistant Examiner* — Joseph J Sadlon
(74) *Attorney, Agent, or Firm* — Harness, Dickey & Pierce, P.L.C.

(57) ABSTRACT

A system for securing plank panels together includes at least one connector clip to secure a pair of plank panels with one another. The at least one connector clip receives the retaining mechanism of each plank panel. The at least connector clip has a body with first and second retaining pockets. The retaining pockets couple with the retention mechanisms. A locator hump is coupled with the body. The locator hump positions the connector clip in place with respect to at least one of the pair of plank panels to secure the connector clip as well as the plank panels with a framing structure.

13 Claims, 2 Drawing Sheets

(56) References Cited

U.S. PATENT DOCUMENTS

| | | | | |
|---|---|---|---|---|
| 7,856,790 | B2 | 12/2010 | Jambois et al. | |
| 8,033,066 | B2 | 10/2011 | Griffiths | |
| 8,117,801 | B2 | 2/2012 | Jambois et al. | |
| D662,805 | S | 7/2012 | Macdonald et al. | |
| 8,240,099 | B2 | 8/2012 | Hummel, III | |
| 8,336,273 | B2 | 12/2012 | Enns | |
| 8,511,014 | B2 * | 8/2013 | Delforte | 52/235 |
| 2002/0124514 | A1 | 9/2002 | Higgins | |
| 2009/0019805 | A1 * | 1/2009 | Zanelli | 52/489.1 |
| 2009/0031652 | A1 | 2/2009 | Ortega Gatalan | |
| 2009/0241444 | A1 | 10/2009 | Griffiths | |
| 2012/0186170 | A1 | 7/2012 | Macdonald et al. | |
| 2013/0205698 | A1 | 8/2013 | Todd et al. | |

FOREIGN PATENT DOCUMENTS

| | | |
|---|---|---|
| DE | 202011100302 | 7/2011 |
| WO | WO 2008/127207 | 10/2008 |

* cited by examiner

BUILDING PANEL CONNECTOR

FIELD

The present disclosure relates to building facades and, more particularly, to a system securing extruded planks to a framing structure.

BACKGROUND

Building facades are attached to the building framing structure in order to provide an aesthetic appearance. When extruded planks are used as the façade material, they are secured by a connector clip. Ordinarily, the extruded planks include retention flanges that are positioned underneath the connector clips to secure the extruded planks to the framing structure.

The extruded planks are positioned adjacent one another with clips spaced along the junction of adjacent extruded planks. Thus, the connector clips are fastened onto the framing structure to secure the extruded planks to the framing structure. The connector clips are generally screwed or bolted into the framing structure. The connector clips include retaining pockets that receive retention flanges from the extruded planks. The connector clips that secure the extruded planks to the framing structure are placed on top of one of the retention flanges and are secured to the framing structure. However, during fastening, the connector clip has the opportunity to rotate on the framing structure. This is cumbersome and requires additional effort by the craftsman to secure the extruded planks in position on the framing structure during attachment of the connector clips.

The present disclosure provides the art with a connector clip and a plank securing system that eliminates rotation of the connector clips on the extruded planks during installation. The connector clips include a locator mechanism to hold the connector clip in position during installation of the connector clips.

SUMMARY

According to the disclosure, a system for securing plank panels comprises a pair of plank panels positioned adjacent one another. Each plank panel includes a retention mechanism. At least one connector clip secures the pair of plank panels with one another on a framing structure. The at least one connector clip couples with the retention mechanisms of each adjacent plank panels. The at least one connector clip includes a body with a first and second retaining pocket. The first and second retaining pockets couple with the retention mechanisms of each adjacent plank panel. A locator hump is coupled with the body. The locator hump positions the connector clip in place with respect to at least one of the pair of plank panels. This locates the connector clip on the plank panel to enable it to be secured with the framing structure. The locator hump includes a cutout to receive a portion of the retention mechanism. This connection prohibits rotation of the connector clip during installation onto the framing structure. The cutout may extend the length of the hump. The at least one retention mechanism has an upturned end. The upturned end fits into the cutout in the hump to position the at least one connector clip against rotation on the plank panel.

According to another object of the present disclosure, a connector clip, to secure a pair of plank panels with one another, comprises a body with a first and second retaining pocket. The first and second retaining pockets couple with the retention mechanisms of each adjacent plank panel. A locator hump is coupled with the body. The locator hump positions the connector clip in place with respect to at least one of the pair of plank panels. This locates the connector clip on the plank panel to enable it to be secured with the framing structure. The locator hump includes a cutout to receive a portion of the retention mechanism. This connection prohibits rotation of the connector clip during installation onto the framing structure. The cutout may extend the length of the hump. The at least one retention mechanism has an upturned end. The upturned end fits into the cutout in the locator hump to position the at least one connector clip against rotation on the plank panel.

Further in accordance with the disclosure, a method of building a wall of plank panels comprises providing a plurality of plank panels. Each plank panel has two sides with retention mechanisms adjacent each side. A plurality of connecting clips is provided. Each connecting clip includes a body with a first and second retaining pocket. The first and second retaining pockets couple with the retention mechanisms of each plank panel. A locator hump is coupled with the body. The locator hump positions the connector clip in place with respect to at least one of the pair of plank panels. This locates the connector clip on the plank panel to enable it to be secured with a framing structure. The locator hump includes a cutout to receive a portion of the retention mechanism. This connector prohibits rotation of the connector clip during installation onto the framing structure. The cutout extends the length of the locator hump. The at least one retention mechanism has an upturned end. The upturned end fits into the cutout in the locator hump to position the at least one connector clip against rotation on the plank panel.

A first plank panel is positioned on a framing structure. At least one connector clip is positioned on the first plank panel. A locator hump receives an upturned portion of the first plank retention mechanism. A second plank panel retention mechanism is slid into the at least one connector clip first or second pocket to retain a side of the second adjacent plank panel in the at least one connector clip. A second connector clip is positioned on the other side of the second plank panel. The locator hump receives the upturned portion on the retaining mechanism of the second panel portion. The positioning of plank panels adjacent one another is repeated by positioning the plank panels and connector clips until a wall is formed.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

DETAILED DESCRIPTION

Example embodiments will now be described more fully with reference to the accompanying drawings.

Figure 1:
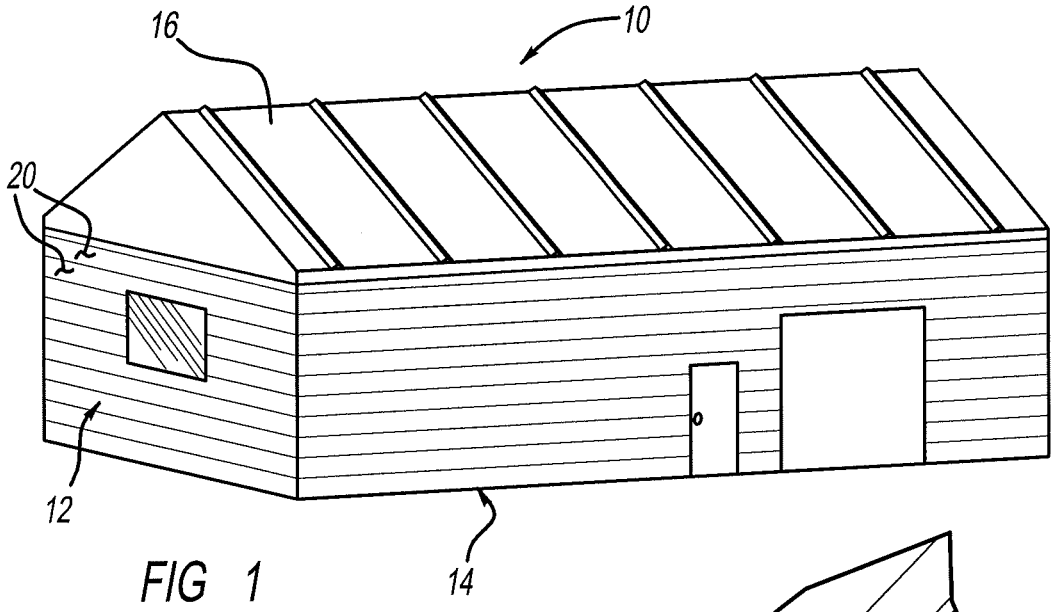
FIG. 1 is a perspective view of a building in accordance with the present disclosure.

Turning to the figures, especially FIG. 1, a building is illustrated and designated with the reference numeral 10. The building has a pair of sidewalls 12, 14 as well as a roof 16. The walls 12, 14 include a façade formed from a plurality of extended extruded plank panels 20. The plank panels are positioned adjacent one another.

Figure 3:
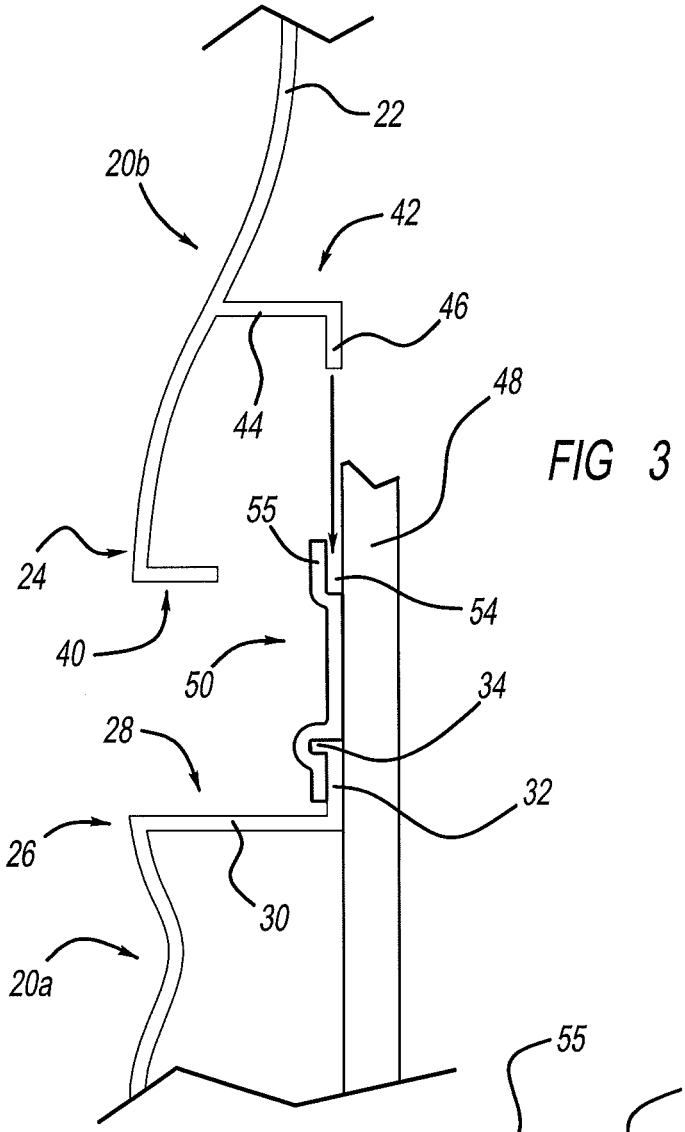
FIG. 3 is a cross-section view of FIG. 2 with a second panel entering a first panel.
Figure 4:
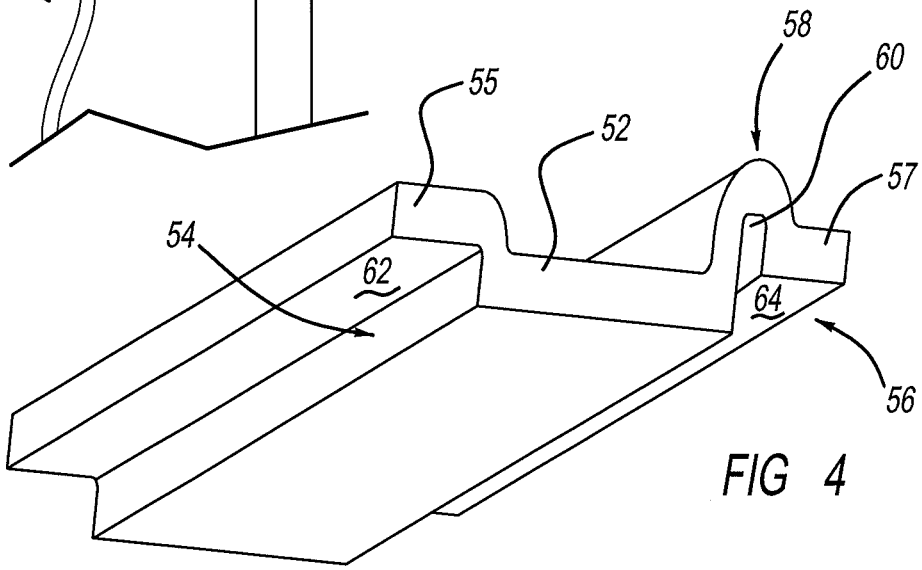
FIG. 4 is a perspective view of a connector clip.

Each plank panel includes a body 22 having a desired configuration. The body 22 may have any type of configuration. As shown, the body 22 has a wave design. The body 22 includes sides 24, 26. Side 26 includes a retention flange 28. The retention flange 28 has an overall L-shape when viewed in cross-section as illustrated in FIG. 3. The L-shape flange has a first leg 30 and a second leg 32. The second leg 32 includes an upturned toe portion 34. All of these portions 30, 32, and 34 may extend the length of the extruded plank panel 20.

The other side 24 of the panel includes a down turned flange 40. An extending retention mechanism 42 is adjacent the side 24 and downturned flange 40. The retention mechanism 42 extends from the underside of the body 22. The retention mechanism 42 has an overall L-shape, in cross-section as seen in FIG. 3, with legs 44, 46. The retention flange 28 and retention mechanism 42 both act to retain the extruded plank panels 20 onto the framing structure 48 of the building 10, via the connector clips 50.

Figure 2:
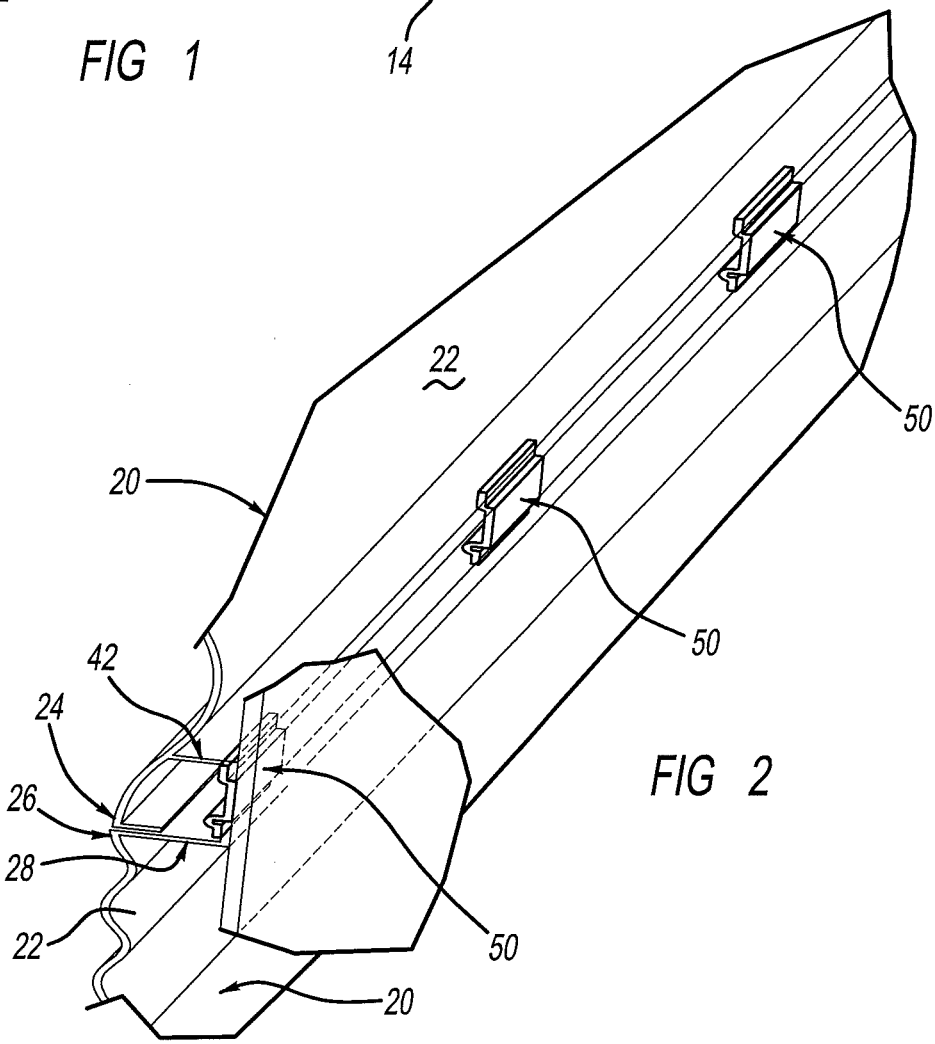
FIG. 2 is a perspective view of extruded plank panels positioned adjacent one another.

The connector clips 50 have an overall rectangular configuration. Each connector clip 50 includes a body 52 and first and second retaining pockets 54, 56. The pockets 54, 56 are defined by flanges 55, 57 extending from the body 52. A locator hump 58 is positioned between the body 52 and the second retaining pocket 56. The second flange 57 extends from the locator hump 58. The locator hump 58 includes a cutout 60 that receives the upturned toe portion 34 of the retention flange 28. The locator hump 58 enables the cutout 60 to receive the upturned toe portion 34. This connection prohibits rotation of the connector clip 50 on the extruded plank panel 20 during installation of the connector clip 50 onto the framing structure 48. The connector clip 50 secures the extruded plank panel 20 onto the framing structure 48. The connector clip 50 may be stamped from a metallic material. The retaining flanges 55, 57 have a bottom surface 62, 64. The bottom surface 62, 64, defining the pockets 54, 56, are substantially co-planar. The locator hump cutout 60 extends upward from the planar surface 64. The locator hump 58 has an overall U-shape in cross section as illustrated in FIG. 2. Thus, the flange 57 extends from the locator hump 58.

A method for securing the plank panels will be described. A first extruded panel 20*a* is positioned adjacent to the bottom of the support structure 48. At least one connector clip 50 is positioned adjacent the panel 20*a*. The connector clip 50 cutout 60 mates with the flange 28 and upturned toe portion 34. A fastener, such as screw or the like, is passed through the body 52 of the connector clip 50. Due to the connection between the locator hump cutout 60 and the flange upturned toe portion 34, the connector clip 50 is prevented from rotating during the installation process. A plurality of connector clips 50 are positioned along the longitudinal length of the flange 28 as illustrated in FIG. 2. Next, the second plank panel is positioned adjacent the first plank panel 20*b*. Here, the retention mechanism flange 42 has leg 46 frictionally slid into the first retaining pocket 54. As this occurs, the downturned flange 40 abuts against the leg 30 of the flange 28. After the retention flange 42 is positioned along the length of the first extruded plank panel 20*a*, via the connector clips 50, a second plurality of connector clips 50 is positioned onto the flange 28 of the second extruded plank panel 20*b*. The locator hump cutout 60 is mated with the upturned toe portion 34 of the flange 28 and is secured, via a fastener, to the framing structure 48. This continues along the length of the second plank panel 20*b*. A third extruded plank panel is inserted into the first flange pocket 54 of the second plurality of connector clips 50 and the process is repeated until the desired façade wall is formed as illustrated in FIG. 1.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A system for securing plank panels together comprising:

a pair of plank panels positioned adjacent one another, each panel including a retention mechanism;

at least one connector clip for securing the pair of plank panels with one another and to a framing structure, the at least one connector clip coupling with the retention mechanism of each plank panel, the at least one connector clip including a body with a pair of flanges and a first and second retaining pocket positioned between the flanges and the framing structure, the first and second retaining pockets receive the retention mechanisms of each plank panel such that the retention mechanisms are aligned with the body on the framing structure, a locator hump is coupled with one flange of the body, the locator hump including a member for receiving a portion of the retention mechanism of one of the pair of planks for preventing rotation and for positioning the connector clip onto one of the pair of plank panels such that the connector clip is maintained on the panel and securing the connector clip and the one of the pair of plank panels with the framing structure.

2. The system for securing plank panels of claim 1, wherein the hump member includes a cutout to receive the portion of one of the retention mechanism to prohibit rotation of the connector clip during installation to the framing structure.

3. The system for securing plank panels of claim 2, wherein the cutout extends along the locator hump.

4. The system for securing plank panels of claim 1, where at least one of the retention mechanisms has an upturned toe.

5. The system for securing plank panels of claim 4, wherein the upturned toe fits into the receiving member in the locator hump to prohibit rotation of the at least one connector clip.

6. A connector clip for securing a pair of plank panels with one another and to a framing structure comprising:

a body with a first and second flanges, a first and second retaining pocket each formed between one of the first and second flanges and the framing structure, the first and second retaining pockets receive retention mechanisms of each of a pair of plank panels so that the body and retention mechanism are aligned with one another to be positioned on the framing structure, a locator hump coupled with a first flange of the body, the locator hump including a portion of the second retaining pocket, the portion of the second retaining pocket is transverse to the first retaining pocket, the portion of the second retaining pocket receiving a portion of the retention mechanism of one of the pair of planks for positioning the connector clip on one of the pair of plank panels to secure the connector clip and one of the pair of plank panels with the framing structure and the other of the pair of plank panels.

7. The connector clip of claim 6, wherein the locator hump member including a cutout to receive the portion of at least one retention mechanism to prohibit rotation of the connector clip during installation onto the framing structure and at least one of the plank panels.

8. The connector clip of claim 7, wherein the cutout extends the length of the locator hump.

9. The connector clip of claim 6, wherein the receiving portion in the locator hump is above the second flange.

10. A method of building a façade wall of plank panels comprising:

providing a plurality of plank panels, each panel having two sides and a retention mechanism adjacent each side;

providing a plurality of connector clips, each connector clip including a body with a pair of flanges, a first and second retaining pocket each formed between one of the pair of flanges and the framing structure, the first and second retaining pockets receive retention mechanisms of each plank panel so that the body and retention mechanism are aligned with one another to be positioned on the framing structure, a locator hump coupled with one of the flanges of the body, the locator hump positioning the connector clip in place with respect to at least one of the plank panels to secure the connector clip and an adjacent one of the plank panels with a framing structure;

positioning a first plank panel on the framing structure;

positioning at least one of the connector clips on the first plank panel such that the locator hump is retained on a portion of the retention mechanism of the first plank panel;

securing the at least one connector clip to the first plank panel and framing structure;

sliding a second plank panel retention mechanism into the at least one connector clip's first or second pocket to retain an adjacent side of the second plank panel in the at least one connector clip;

positioning a second connector clip on the other side of the second plank panel such that the locator hump is retained on a portion of the retaining mechanism of the second plank panel; and repeating the position of plank panels and connector clips and securing of the connector clips until the wall is formed.

11. The method of claim 10, wherein a plurality of connector clips secure each plank panel.

12. The method of claim 10, wherein the portion of the retention mechanism fits into a cutout in the locator hump to prohibit rotation of the at least one connector clip.

13. The method of claim 10, wherein the retention mechanism engages across an entire length of the connector clip.

* * * * *